US005098514A

United States Patent [19]

Held

[11] Patent Number: 5,098,514

[45] Date of Patent: Mar. 24, 1992

[54] DOUBLE BAND PRESS WITH HEATABLE OR COOLABLE PARTS AND METHOD FOR THEIR FABRICATION

[76] Inventor: Kurt Held, Alte Strasse 1, D-7218 Trossingen 2, Fed. Rep. of Germany

[21] Appl. No.: 569,236

[22] Filed: Aug. 17, 1990

Related U.S. Application Data

[63] Continuation of Ser. No. 197,831, May 23, 1988, abandoned.

[30] Foreign Application Priority Data

May 26, 1987 [DE] Fed. Rep. of Germany ..... 3717649

[51] Int. Cl.[5] ..... B30B 5/06; B30B 15/34

[52] U.S. Cl. ..... 156/583.1; 156/583.5; 165/168; 165/177; 165/179; 165/183

[58] Field of Search ..... 156/580, 583.1, 583.5; 138/38; 165/168, 177, 179, 183; 29/890.046, 890.047, 890.049; 100/93 P, 93 RP

[56] References Cited

U.S. PATENT DOCUMENTS

| | | | |
|---|---|---|---|
| 682,488 | 9/1901 | O'Brien | 138/38 |
| 1,905,653 | 4/1933 | Schranz | 165/168 |
| 2,627,290 | 2/1953 | Berthelsen | 100/93 P X |
| 2,722,733 | 11/1955 | Meyer et al. | 165/179 |
| 2,731,709 | 1/1956 | Gaddis et al. | 165/179 |
| 2,930,405 | 3/1960 | Welsh | 138/38 |
| 3,200,848 | 8/1965 | Takagi . | |
| 3,498,349 | 3/1970 | Heikinheimo | 156/583.1 |
| 3,851,685 | 12/1974 | Ahrueiler et al. | 156/583.5 |
| 3,887,004 | 6/1975 | Beck | 165/179 |
| 4,163,474 | 8/1979 | MacDonald et al. . | |
| 4,304,178 | 12/1981 | Häberle | 156/583.1 X |
| 4,353,416 | 10/1982 | Buschfeld | 165/168 |
| 4,419,802 | 12/1983 | Riese | 165/179 X |
| 4,466,857 | 8/1984 | Pfeiffer | 156/583.1 X |
| 4,541,889 | 9/1985 | Held | 156/583.5 |
| 4,615,758 | 10/1986 | Held | 156/359 |
| 4,854,026 | 8/1989 | Averdick et al. | 100/93 P |

FOREIGN PATENT DOCUMENTS

| | | | |
|---|---|---|---|
| 1953816 | 7/1971 | Fed. Rep. of Germany . | |
| 2421296 | 11/1975 | Fed. Rep. of Germany . | |
| 3325578 | 1/1985 | Fed. Rep. of Germany . | |
| 3337913 | 5/1985 | Fed. Rep. of Germany . | |
| 0698695 | 11/1930 | France | 165/179 |
| 484455 | 6/1938 | United Kingdom . | |
| 865983 | 11/1959 | United Kingdom | 165/179 |

*Primary Examiner*—Michael W. Ball
*Assistant Examiner*—Steven D. Maki
*Attorney, Agent, or Firm*—Toren, McGeady & Associates

[57] ABSTRACT

Heatable or coolable portions of a double band press or a single or multiplaten press have channels for a fluid heat carrier. In these channels, heat is exchanged by convection between the walls of the channels and the heat carrier fluid. Surface enlarging inserts of a material with good heat conducting properties are inserted into the channels in order to improve heat exchange. These surface enlarging inserts have a surface which is fastened to the walls of the channels in order to improve heat exchange. Several elements projecting into the flow of the heat carrier fluid emanate from this surface of the surface enlarging insert. The surface enlarging insert is composed of several identical or different individual parts which are fabricated separately and subsequently inserted into the channels in such a way that they have area contact with the wall of the channels.

20 Claims, 5 Drawing Sheets

DOUBLE BAND PRESS WITH HEATABLE OR COOLABLE PARTS AND METHOD FOR THEIR FABRICATION

This is a continuation application of Ser. No. 07/197,831, filed May 23, 1988, now abandoned.

FIELD AND BACKGROUND OF THE INVENTION

The present invention is directed to a double band press or a single or multiplaten press, with heatable or coolable parts, and to the process for the fabrication of these parts.

Double band presses are used for continuous pressing or extrusion of material webs. These presses exert a uniform area pressure upon the material to be pressed or molded by means of endless press bands arranged one above the other and conducted over reversing drums, while, at the same time, the commodity to be pressed is continuously conveyed through the double band press (see DE-OS 24 21 296). Such material webs can, for instance, consist of several layers of paper webs, woven glass fiber webs, laminated webs with metal foil placed thereon, fiber binder mixtures of the like, which are stacked one upon the other and impregnated with duroplastic or thermoplastic resins. These materials webs can require the use of a specific temperature during the extrusion process, in order to cure the binder contained in the material web and to connect the individual layers with each other to form a compact, pressed product. Especially in the case of thermoplastic binders, it can also be necessary to subsequently cool the pressed product in the double band press with the application of area pressure.

It is known to heat the press band of the double band press at the reversing drums on the inlet side of the press so that a specific quantity of heat is transferred into the region of the so-called reaction zone, where the material to be pressed is located between the press bands and is subjected to area pressure, and to there transfer the heat to the material to be pressed. Because of the limited heat capacity of the press bands, this quantity of heat is insufficient as a rule. Heat-conducting elements have become known from DE-OS 33 25 578 with whose help additional heat can be transmitted in the reaction zone to the press bands. These heat-conducting elements consist of material with good heat-conducting properties and are arranged with one surface at the pressure plate in the double band press while assuring good heat-conducting contact. The other surface of the heat-conducting element contacts the inner sides of the press band in the region of the reaction zone in a sliding manner. The pressure plates are heated to a higher temperature than that required in the reaction zone, so that a pressure gradient is produced between the pressure plates and the press bands and the heat flow is directed from the pressure plates through the heat conducting elements to the press band. This additional heat is then transferred by the press bands to the material to be pressed or extruded. With such an arrangement, a cooling of the press bands is also possible by cooling the pressure plate.

It is known from DE-OS 24 21 296 to configure channels designed as bores in the pressure plate for heating the pressure plates in the double band press, through which channels heated fluid medium flows. A liquid, such as thermal oil or a cooling liquid or a gas or steam, is, for instance, suitable as the fluid medium. Such fluid media exchange heat with the walls of the channels. Specifically, they yield heat of the walls of the channel by means of convection in the case of a heated medium, or absorb heat from the walls of the channels by means of convection in the case of a cooled medium. These fluid media are, in the following, called heat carrier means for short. The heating of other portions of the double band press, for instance, the press stand, by a heat carrier means circulating through channels in these parts is shown in DE-OS 33 37 913.

For improving heat transmission between the heat carrier means and the pressure plate, it is further known from DE-OS 33 25 578 to configure axially extending depressions and protrusions in the walls of the channels in order to thus increase the surface of the channel inner wall. While bores with circular cross sections are comparatively easy to fabricate in the heatable or coolable parts of the double band press, such depressions and protrusions are difficult to fabricate from a production technology point of view. Furthermore, it is disadvantageous that the surface increase achieved by the protrusions and depressions is often inadequate to transfer sufficient heat between the heat carrier means and the heatable or coolable parts of the double band press.

SUMMARY OF THE INVENTION

Proceeding from this state of the art, the present invention is based upon the task of improving heat transmission by convection between the heat carrier means, flowing in channels of heatable or coolable parts of the press, and the parts themselves, whether the press is a double band press, single platen press or a multiplaten press.

In accordance with the present invention, a press for the fabrication of material webs in a reaction zone between two pressing members is provided with means for heating or cooling the press, which means comprise channels through members of the press. In accordance with the invention, a surface increasing insert made of material which has good heat conducting properties is arranged in the channel. At least one surface of the insert is in good heat conducting contact with the wall of the channel and includes a plurality of elements which extend from the channel wall into the channel. The heat carrier means, that is, the heat transfer fluid, thus flows past the insert which increases the transfer of heat to or from the press.

The inserts of the present invention may be provided in the channels of a double band press, a single platen press or a multiplaten press.

The present invention also includes a process for fabricating the heatable or coolable portions of a press which include channels into which a plurality of individual parts are assembled to form surface increasing inserts in the channels.

The advantages achieved by the invention consist in that sufficient heat can be made available in the reaction zone also for materials which require a greater amount of heat for curing. The cooling of materials in the reaction zone can be performed at a faster rate. Thus, the throughput through the double band press can be increased or a continuous fabrication of materials enabled, which hitherto could not be produced continuously. The channels realized in the invention in the parts of the double band press are easy to fabricate from the standpoint of production technology. Channels consisting of simple bores only for the heat carrier means can be used for the present invention.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there are illustrated and described the preferred embodiments of the invention.

DESCRIPTION OF THE PREFERRED EMBODIMENTS

Figure 1:
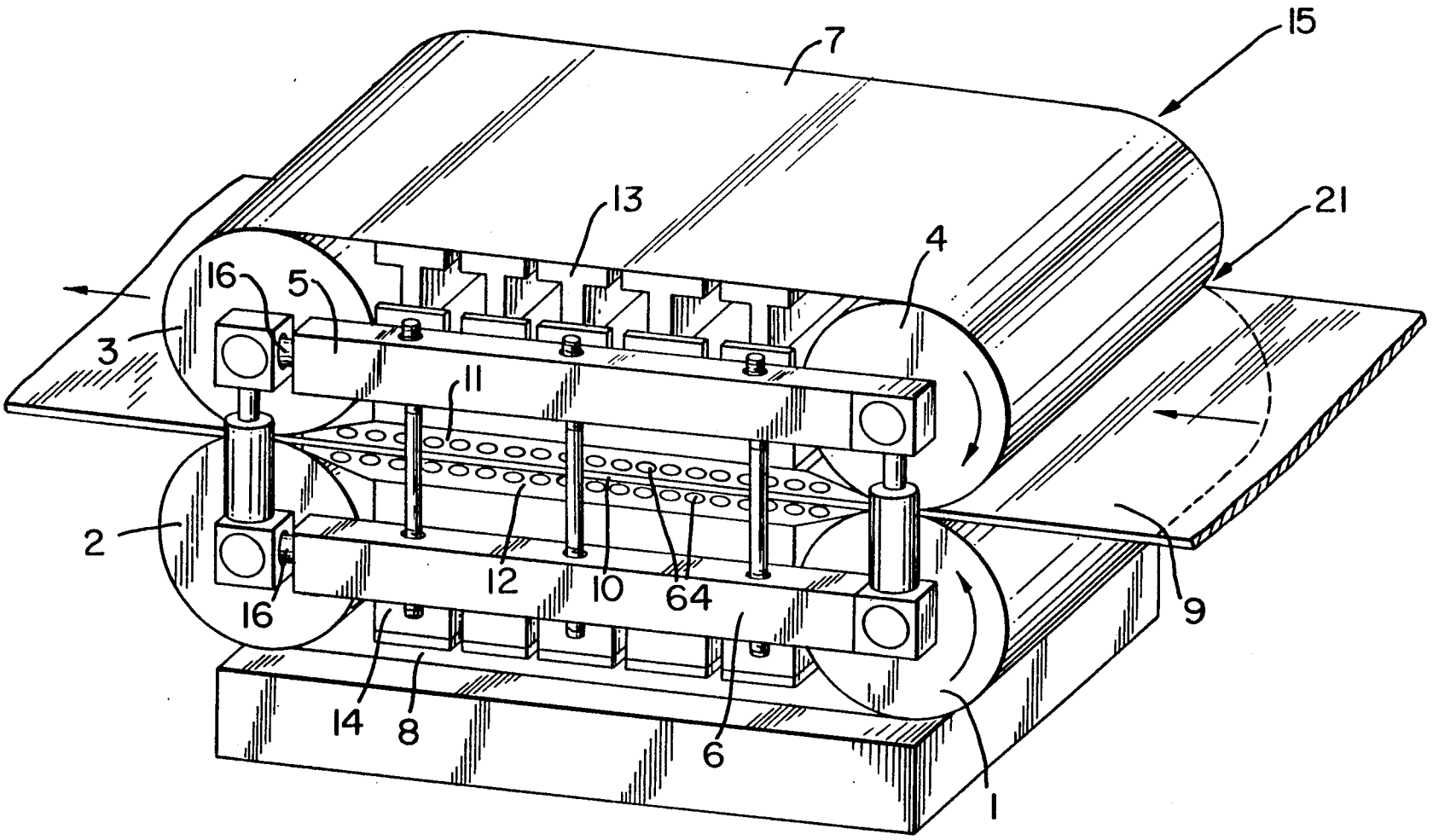
FIG. 1 is a diagrammatic side perspective view of a double band press.

The continuously functioning double band press 15 shown in FIG. 1 has four reversing drums 1, 2, 3, 4, rotatably supported in bearing brackets 5, 6. An endless press band 7, 8 is conducted around respective pairs of reversing drums 1 and 2 or 3 and 4, which drums rotate in the direction of the arrows in the reversing drums 1 and 4. The press bands 7, 8 which normally consist of a high tensile steel strip, are stretched by known means, for instance, by hydraulic cylinders 16 (see also FIG. 2), fastened in the bearing brackets 5, 6. A reaction zone 10 lies between the lower section of the upperpress band 7 and the upper section of the lower press band 8, in which reaction zone the material web 9 which is fed from right to left in the drawing, is pressed or extruded under the effect of area pressure and heat. The material web 9 consists of fabrics, laminated materials, fiber binder mixtures and the like which are impregnated with synthetic resin. For instance, such a material web 9 can be composed of individual woven glass fiber webs stacked one upon the other which are impregnated with epoxy resin and superimposed copper foil webs. Such a copper-coated laminate serves as initial material for the fabrication of printed circuit boards.

The area pressure exerted upon the material web 9 at the reaction zone 10 is applied hydraulically or mechanically to the inner sides of the press bands 7, 8 and is transmitted from these to the material web 9. The reaction forces exerted by the pressed material are transmitted by pressure plates 11, 12 into the press stand 13, 14 which is only shown in diagrammatic form. The bearing brackets 5, 6 are also fastened to the press stand 13, 14.

Figure 2:
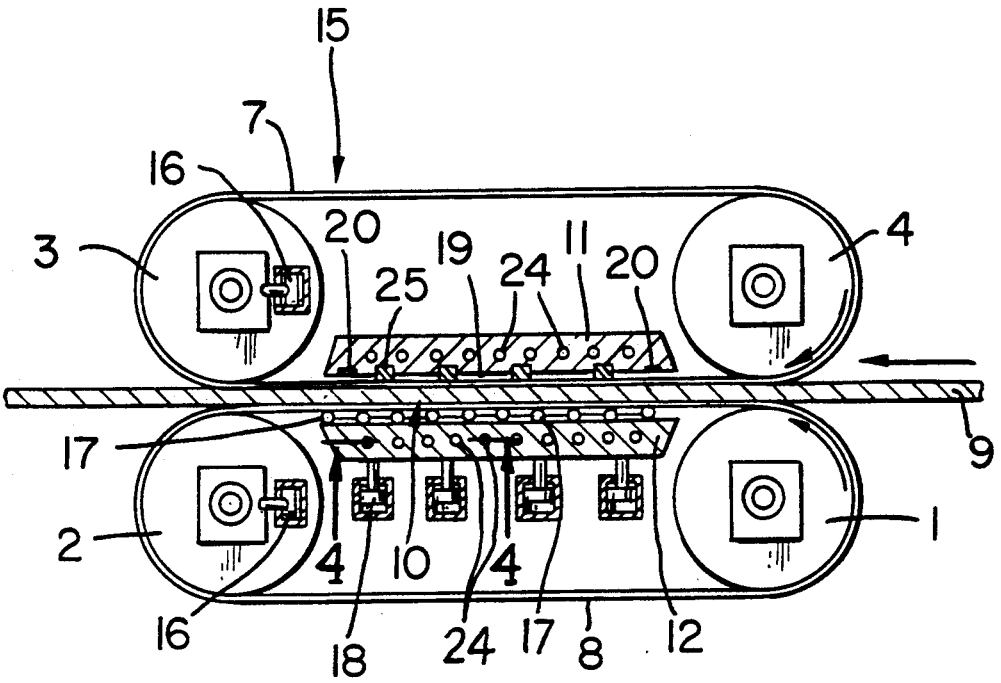
FIG. 2 is a diagrammatic longitudinal sectional view through the double band press of FIG. 1.

Stationary rollers 17 are arranged as shown in FIG. 2 at the lower press band unit between the pressure plate 12 and the inner side of the press band 8 for mechanical generation of the area pressure acting upon the material web 9. The pressure plate 12 and with it also the rollers 17, are advanced against the inner side of the press band by hydraulic cylinders 18. In the hydraulic pressure transmission, a fluid pressure medium which can be subjected to pressure is introduced into the space between the pressure plate 11 and the inner side of the press band 7 as is shown in FIG. 2, at the upper press band unit. This space, the so-called pressure chamber 19, is bounded on its sides by a sliding face seal 20 which is closed on itself in an annular shape, and attached to the pressure plate 11. This seal slides upon the inner side of the press band 7. Synthetic oil is preferably used as a pressure medium. Gas, for instance, compressed air, can be utilized equally well. Naturally, the pressure plate 11 can also be equipped with a mechanical pressure transmittal system or the pressure plate 12 can be equipped with a hydraulic pressure transmittal system.

In the following, the present invention is further explained with the help of a double band press with a hydraulic pressure transmission system. The invention, however, can be utilized equally well with double band presses having a mechanical pressure transmission system.

Figure 3:
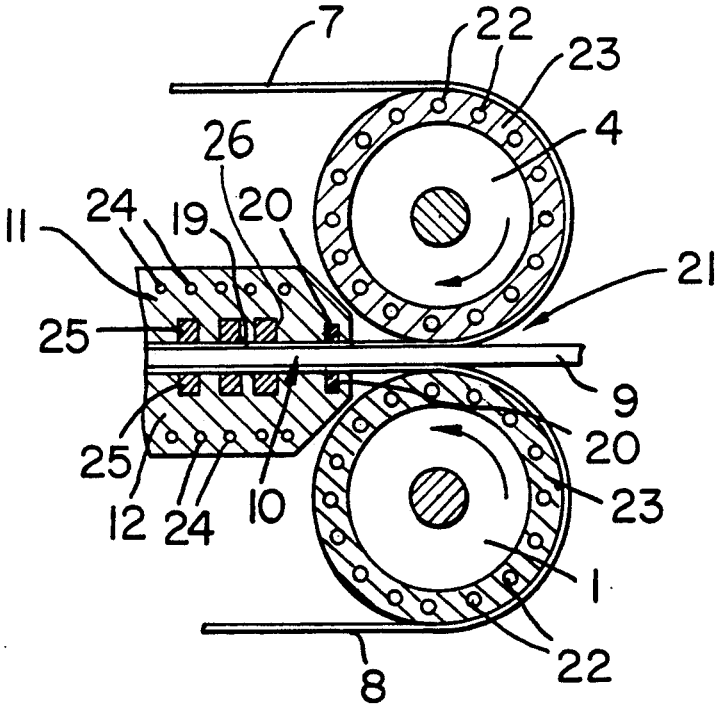
FIG. 3 is an enlarged detail of a double band press.

In FIG. 3, where the same numerals are used to designate similar parts, the inlet region 21 of a double band press in longitudinal section, is depicted. The reversing drums 1 and 4 located at the inlet side of the press band 7, 8 viewed in the feed direction are heated. For this purpose, channels 22 are located in the circumferential jacket area 23 of the cylindrical reversing drums 1 and 4. A heat carrier means, for instance, thermal oil, circulates through the channels 22 which yields heat by convection to the reversing drums 1, 4. The heat in the reversing drums 1, 4 is transmitted by these to the press bands 7, 8 which transport the quantity of heat received from the reversing drums 1, 4 into the reaction zone 10.

Figure 4:
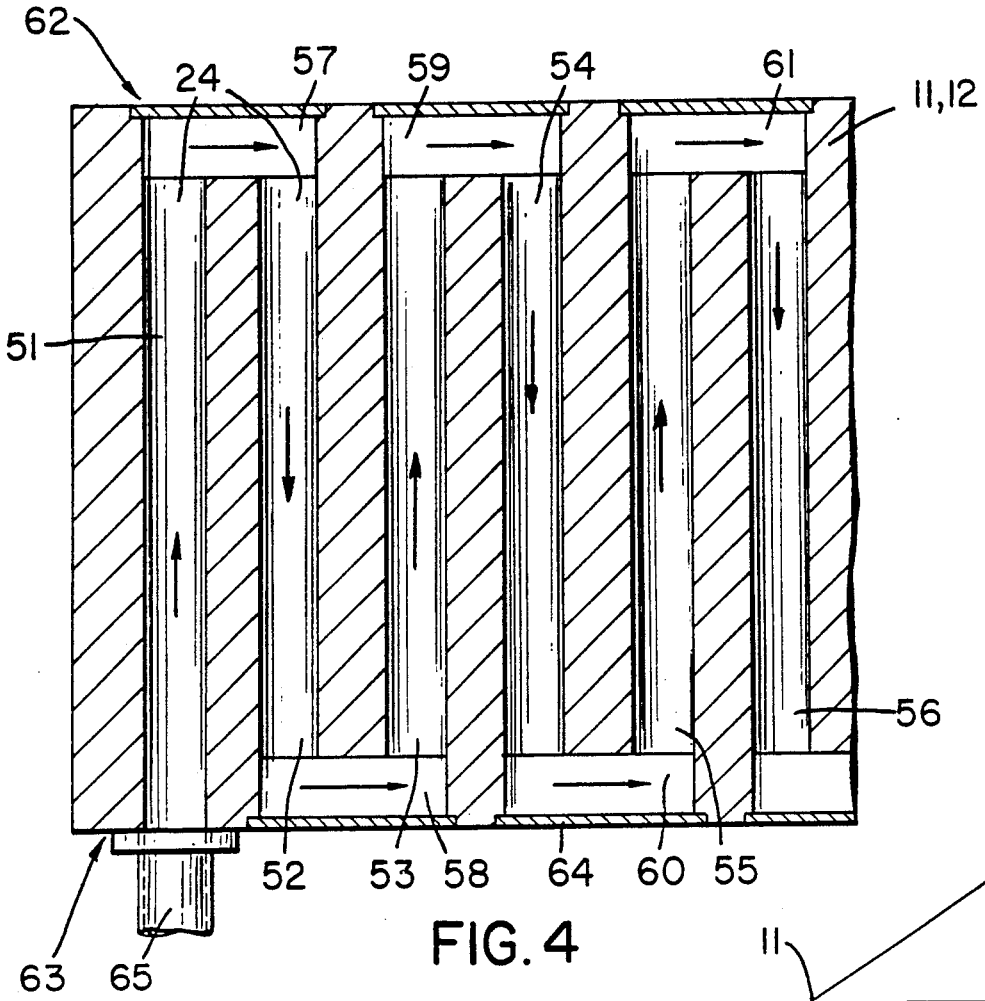
FIG. 4 is a sectional view of a pressure plate in the double band press taken along line IV—IV of FIG. 2.

The pressure plates 11, 12 are also heated. They have, as FIGS. 2 and 3 show, channels 24 through which heat carrier means also flow. The arrangement of the channels 24 can be seen in clearer detail in FIG. 4 which shows a section along the line IV—IV in FIG. 2. They consist of bores 51 to 56 which extend transversely across the width of the pressure plate 11, 12. At the longitudinal sides 62, 63 of the pressure plate 11, 12, oblong recesses 57 to 61 are provided, respectively which connect two adjacent bores 51 to 56 in progressive sequence and alternately at both longitudinal sides 62, 63 with each other. The bores 51 and 52 are connected through the recesses 57 at the longitudinal side of the pressure plate, the bores 52 and 53 are connected by the recess 58 at the longitudinal side 63, and then the bores 53 and 54 again at the longitudinal side 62 by the recess 59, etc. The recesses 57 to 61 are sealed at the external side of the pressure plate 11, 12 by a soldered-in or welded-in cover 64 (see FIGS. 1 and 4) so that a system of channels 24 is formed which extends through the pressure plate 11, 12 in meandering fashion. The heat carrier means is directed into the bore 51 by a supply line 65 and flows then through the channels 24 in the pressure plate 11, 12 in the direction of the arrows depicted in FIG. 4. The heat carrier means yields heat during its flow through the channels 24, to the walls of the channels 24 by means of heat transmission by convection and thus heats the pressure plates 11, 12.

Figure 5:
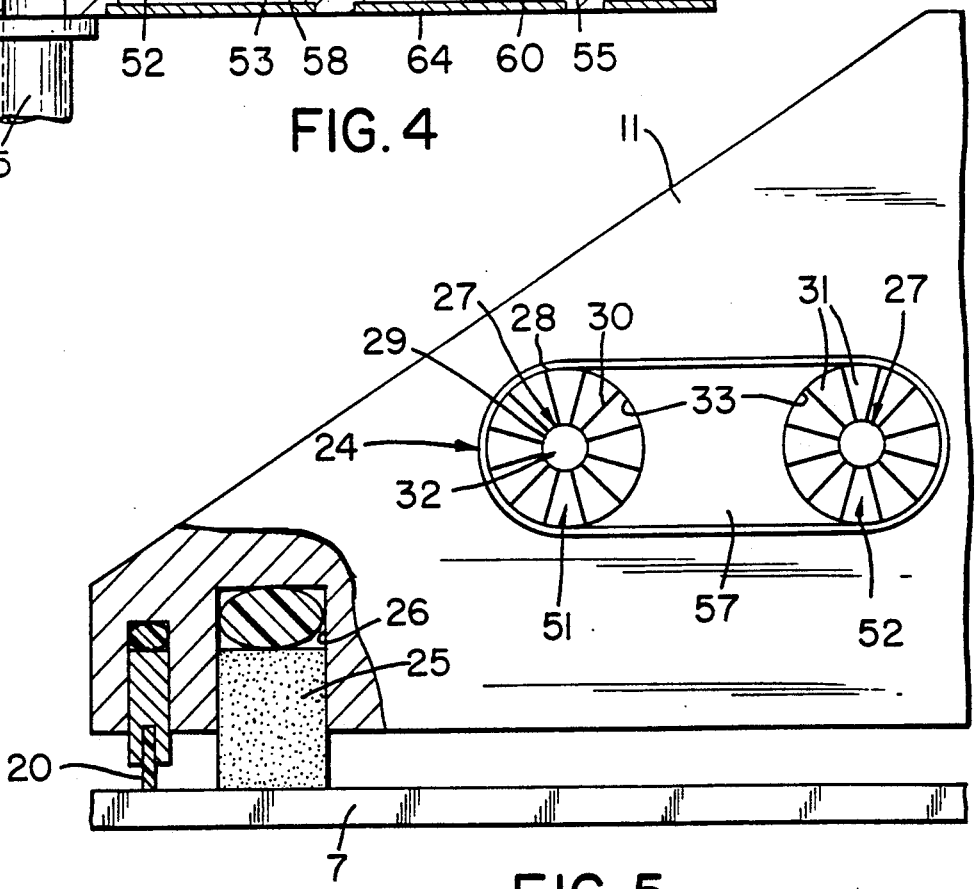
FIG. 5 is a cross-sectional view through a channel for the heat carrier means in the pressure plate of FIG. 4.

Heat conducting elements 25 are arranged in grooves 26 in the pressure plates 11, 12. The openings of these grooves face the inner side of the press bands 7, 8, as is shown in FIG. 5. The heat-conducting elements 25 lie with one portion of their surface facing away from the press band 7 and 8, at the walls of the groove 26, so that they have good heat-conducting contact with the pressure plate 11, 12. The surfaces of the heat-conducting elements 25 which face the press band 7, 8 contacts the inner side of the press band 7, 8 in a sliding manner. Since the pressure plate 11, 12 is heated to a temperature that is higher than the temperature specified in the reaction zone 10, a heat gradient between the pressure plates 11, 12 and the press bands 7, 8 is formed where heat is transmitted from the pressure plate 11, 12 through the heat-conducting elements 25 to the press bands 7, 8 in the reaction zone. This heat is directed from the press bands 7, 8 to the material web 9 resting against the press bands 7, 8 in the reaction zone. The detailed design of the heat-conducting elements 25 is known from DE-OS 33 25 578 and does not need to be explained in detail here.

It must be emphasized that such an arrangement is also suitable for cooling the commodity to be pressed in the reaction zone 10 of a double band press. For this purpose, the pressure plate 11, 12 is cooled by circulating a cold heat carrier means through the channel 24. A heat gradient between the material web 9 and the pressure plate 11, 12 in the reaction zone 10 is formed. Thus, heat flows from the material web 9 through the press bands 7, 8 and the conducting elements 25, to the pressure plate 11, 12. From the pressure plate 11, 12 this heat is then absorbed by the heat carrier means in the channels 24 through heat transmission by convection, and is transported away. If required by the pressed commodity, naturally heatable and coolable pressure plates can be consecuritely arranged in the double band press in order thus to enable a heating and cooling of the material web under pressure in the reaction zone.

If necessary, other portions of the double band press can be provided with channels in which the heat carrier means is circulating for heating or cooling of these parts. As is known from DE-OS 33 37 913, also, the press stand or at least parts thereof can be heated or, of desired, also cooled in this manner in addition to the reversing drums on the inlet sides of the press.

The channels 24 in which the heat carrier means circulates, as a rule, consists of bores with circular cross sections because of production technology considerations. Indeed, it has been shown, especially in pressure plates in the double band press, that in many cases the heat to be transmitted by the heat carrier means to the pressure plate or the heat to be absorbed by the heat carrier means from the pressure plate is inadequate. If the commodity to be pressed is to be heated in such cases, too little heat is transmitted to the commodity and it is not completely cured in the double band press, wherein in the final anaylsis, an end product of lower quality is produced. If the pressed commodity is to be cooled, then too little heat is removed from it and the pressed commodity leaves the double band press in too hot a state, whereby in the final anaylsis also, an end product of lower quality is produced. It has now been found that the heat quantity absorbed by or yielded to the heat carrier means circulated in the channels 24 can be considerably increased by providing the channel 24 with a surface enlarging insert 27 which is made of material with good heat-conducting properties and which is fastened to the wall of the channel 24 with good heat-conducting contact. This insert has several elements which protrude into the flow of the heat carrier means.

An embodiment of such a surface enlarging insert 27 is depicted in more detail in FIG. 5. The surface enlarging insert 27 is produced of copper plate and has an inner hollow cylinder 29 arranged in an outer hollow cylinder 28. The outer hollow cylinder 28 has a diameter which is only slightly smaller than the diameter of the bores 51 to 56 of the channel 24, so that the outer hollow cylinder 28 just fits into each bore 51 to 56 and rests at the wall 33 of the bores 51 to 56 with its external outer mantle surface. The inner hollow cylinder 29 has a considerably smaller diameter than the outer hollow cylinder 28. Both hollow cylinders 28, 29 are arranged in such a way that their cross sections lie in concentric circles. The inner hollow cylinder 29 is connected to the outer hollow cylinder 28 by webs 30 which converge radially in the direction of an imagined center point of the concentric circles. The surface increasing insert 27 therefore subdivides each bore 51 to 56 into a round channel segment 32 and several prismatic channel segments 31 grouped around this round segment. Since the surface enlarging insert 27 extends across the entire bore 51 to 56 between two recesses 57 and 58 or 59 and 60, the heat carrier means flowing in the channel 24 is divided into several partial streams by the surface increasing insert 27, which partial streams flow in the round channel segments 32 and in the prismatic channel segments 31. Each of these partial flows now transfers heat by means of convection to the walls of the segment 31 and 32 surrounding it or it absorbs heat therefrom. In the round channel segments 32, this wall is formed by the inner surface of the inner hollow cylinder 29. In the case of prismatic channel segments 31, the walls are formed by the surfaces of two webs 30, a portion of the outer mantle surface of the inner hollow cylinder 29 and a portion of the inner mantle surface of the outer hollow cylinder 28. The entire heat yielded by the partial flows to the walls of the channel segments 31, 32 flows by heat conduction in the material of the surface increasing insert 27 which is a good heat conductor, in the direction of the outer hollow cylinder 28. The outer mantle surface of the outer hollow cylinder 28 is soldered to the wall 33 of the bore 51 to 56, so that the heat flows from the outer hollow cylinder 28 through the metallic solder with good heat-conducting properties into the pressure plate 11 and thus heats it. Instead of soldering the outer hollow cylinder 28 to the wall 33 of the bore 51 to 56, the surface increasing insert 27 can also be pressed or clamped into the bore 51 to 56 in such a way that the external surface of the outer hollow cylinder 28 contacts the wall 33 with a contact pressure. By suitably selecting the radius of the hollow cylinder 28, one assures that the contact pressure is large enough in order to make sure that a good heat transmission between wall 33 and the outer surface of the outer hollow cylinder 28 exists. Analogous considerations also apply for the cooling of the pressure plate 11, 12 in the reverse direction of the heat flow. It has been shown that the heat transmission between the heat carrier means and the wall 33 of the channel 24 can be greatly improved by means of such a surface increasing insert 27, whose surfaces fastened to the wall 33 of the channel 24 are constituted by the outer surface of the outer hollow cylinder 28 and where the elements protruding into the flow of the heat carrier means are constituted by the webs 30 and the inner hollow cylinder 29.

Figure 6:
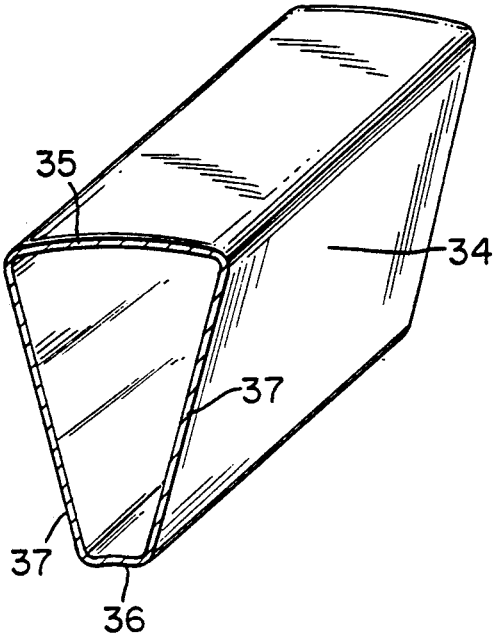
FIG. 6 is a partial perspective view of a profile tube for fabrication of the area enlarging insert in the channel for the heat carrier means of the press.
Figure 7:
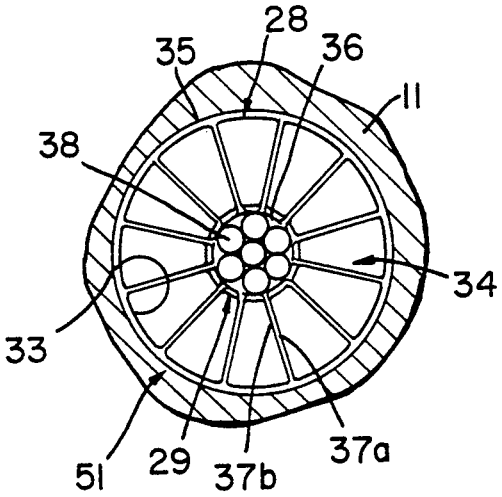
FIG. 7 is an enlarged cross-sectional view through a channel for the heat carrier means in the course of fabrication.

For fabrication of the channels 24 in the pressure plate 11, 12, these are equipped with corresponding bores 51 to 56 with circular cross sections and recesses 57 to 61 connecting the bores 51 to 56 at the longitudinal sides of the pressure plate 11, 12 (see FIG. 3). It has been shown to be particularly expedient to build up the surface increasing insert 27 from individual copper sections 34 which can be seen in FIG. 6. The copper section 34 has a hollow profile of prismatic shape. Viewed in cross section, the copper section 34 has an outer curved wall 35, whose radius of curvature is exactly equal to the radius of the outer hollow cylinder 28, as well as having an inner curved wall 36, whose radius of curvature corresponds to the radius of the inner hollow cylinder 29. The two walls 35 and 36 are connected in such a way by two additional radial walls 37 that converge toward each other at a certain angle that essentially form a triangular shape with a blunted tip. This copper section 34 is formed of a copper tube by means of a tool having a corresponding prismatic cross-sectional shape. Subsequently, these copper sections are inserted next to each other in such a way in the bore 51 to 56 that the outer curved wall 35 rest at the wall 33 of the bore 51 to 56 and the radial walls 37*a*, 37*b* of two adjacent copper sections 34 contact each other across their entire surface as shown in FIG. 7. In the present embodiment, the angles between the walls of the copper section 34 are selected in such a way that twelve such copper sections 34 are required in order to completely fill the bore 51 to 56 as can be gathered from FIG. 7. Subsequently, several cylindrical hard solder rods 38 are placed in the space formed by the inner curved walls 36, which space constitutes the round channel segment 32. After this, the copper sections 34 are soldered together to form the surface enlarging insert 27. To this end, and after all the bores 51 to 56 in the pressure plate 11, 12 which are to receive this surface enlarging insert 27 have been equipped with copper sections 34 and hard solder rods 38, the pressure plates 11, 12 are placed into a vacuum soldering furnace. The pressure plate is subsequently heated to the soldering temperature in the vacuum soldering furnace, hereby the solder melts and penetrates between the two radial walls 37*a*, 37*b* of two adjacent copper sections 34. The liquid melt solder is further moved in the direction of the wall toward the bore 51 to 56 because of capillary forces, where it finally penetrates into the gaps between the outer curved wall 35 and the wall 33 of the bore 51 to 56.

In the course of the hard soldering of the individual copper sections 34 with each other, the outer hollow cylinder 28 is formed by the outer curved wall 35 while the inner hollow cylinder 29 is formed by the inner curved wall 36. The webs 30 which connect the outer hollow cylinder 28 with the inner hollow cylinder 29 are constituted by the hard soldering of the respective two adjacent radial walls 37*a*, 37*b*. By filling the soldering gap between the outer hollow cylinder 28 of the wall 33 of the bore 51 to 56, an intimate connection is formed between the solder and the basic material which is enhanced by fusion and alloying processes, and with this also, a connection between the outer hollow cylinder 28 and the wall 33 is formed. The quantity of the hard solder rods 38 as well as the time required for the soldering process are selected in such a manner that a secure filling of all the soldering gaps occurs. With this, it is assured that no heat insulating connecting points arise between the outer hollow cylinder 28 and the wall 33 of the channel 24. Since the metallic solder has also a good heat-conducting coefficient, a good heat transmission is thus assured. No flux is advantageously required if the soldering process is performed in a vacuum furnace since oxidation is avoided due to lack of oxygen. Through this, flaws are also avoided at which heat transmission would be impeded. Instead of soldering in a vacuum furnace, one can also solder in a protective gas atmosphere which, for instance, consists of hydrogen and argon.

Figure 8:
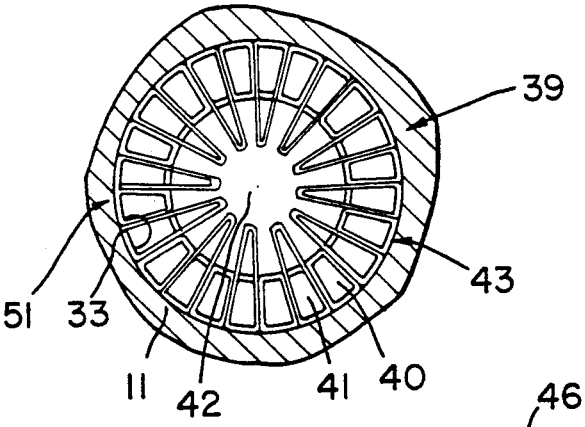
FIG. 8 is a cross-sectional view through the channel for the heat carrier means in another embodiment.
Figure 9A:
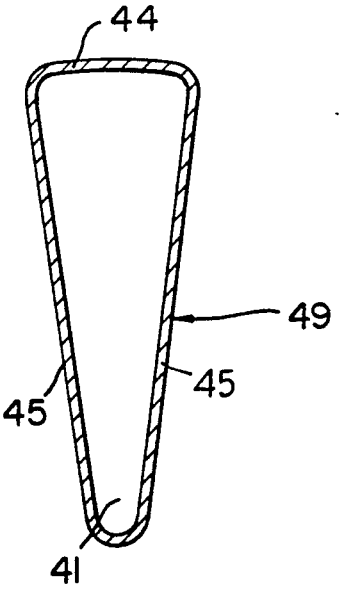
FIGS. 9*a* and 9*b* are sectional views of profile tubes for the fabrication of the surface enlarging insert in the channel for the heat carrier means in another embodiment of the invention.
Figure 9B:
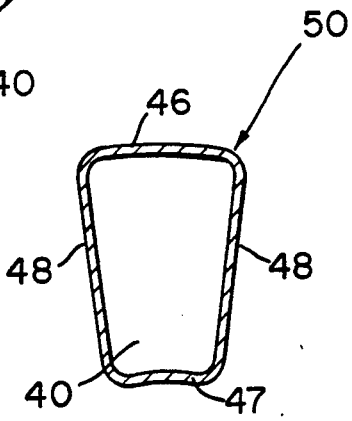

Another embodiment for a surface increasing insert 39 can be seen in FIG. 8. This surface enlarging insert 39 subdivides the bore 51 to 56 into a round channel segment 42 which lies in the middle of the bore 51 to 56 as well as into prismatic channel segments 40 and triangular channel segments 41. The prismatic channel segments 40 and the triangular channel segments 41 are arranged alternatingly in such a way along the wall 33 of the bore 51 to 56 that they form a continuous cylindrical mantle surface 43 which is soldered to the wall 33 of the bore 51 to 56. The cross section of the channel segments 40, 41 can be seen in FIGS. 9*a* and 9*b* in a magnified presentation. The triangularly-shaped channel segment 49 (or 41 in FIG. 8) has a base side 44, whose radius of curvature corresponds to the radius of the bore 51 to 56. The two legs 45 of the triangle are approximately of equal length. The tips of the triangularly-shaped channel segments 41 are rounded off. The prismatic channel segment 50 (or 40 in FIG. 8) has an outer side 46 whose radius of curvature corresponds to the radius of the bore 51 to 56 and an also curved inner side 47 which is arranged concentrically to the outer side 46. The two sides 46 and 47 are connected with each other by two side walls 48 converging towards each other at an angle. The prismatic channel segment 40 as well as the triangularly-shaped channel segment 41 are fabricated from copper tubes by reforming these by a suitable tool into a prismatic copper section 50 or a triangularly-shaped copper section 49.

The fabrication of the surface enlarging insert 39 proceeds analogously to that of the surface enlarging insert 27. After the bores 51 to 56 have been drilled into the pressure plate 11, 12, the triangular copper sections 49 and the prismatic copper sections 50 are alternately inserted into the bore 51 to 56 in such a way that the base side 44 of the copper section 49 and the outer side 46 of the copper section 50 rests at the wall 33 of the bore 51 to 56. Subsequently, the cylindrical soldering rods are inserted in the required quantity into the round channel segment 42 and the copper sections 49, 50 are soldered with the legs 45 along the side walls 48. Simultaneously, the base sides 44 and the outer sides 46 are soldered to the wall 33 of the bore 51 to 56. The soldering process again can occur in the vacuum furnace or in a protective gas atmosphere. It has to be emphasized that a very much better heat transmission between the heat carrier means and the wall 33 of the channel 24 occurs also with this construction of the surface enlarging insert.

The surface enlarging insert 27, 39 consists of a metal with good heat conducting properties as, for instance, copper, bronze, brass, aluminum, beryllium, a copper alloy or the like. The pressure plate 11, 12 consists as a rule of steel. A solder consisting of an alloy with good conducting properties is selected for soldering the surface increasing insert 27, 39 to a pressure plate 11, 12, the melting point of which solder lies above the operating temperature of the heat carrier means, in order to avoid impairment of the soldered connection during operation of the double band press. If the surface enlarging insert 27, 39 consists of copper, solders which consist of a silver compound, nickel compound or a bronze and have a melting temperature of approximately 800° to 1,000° C. have been found to be particularly satisfactory for vacuum soldering the surface enlarging insert 27, 39 to the wall 33 of the channels 24. The melting temperatures of the solders thus lie far above the operational temperature of the pressure plate 11, 12 which, as a rule, does not exceed 250° C. and, on the other hand, they lie below the melting temperature of the surface enlarging insert 27, 39 of copper.

It has been shown to be particularly expedient to provide the individual copper sections 34, 49 or 50 with a surface coating of solder. This coating can be applied galvanically. A galganic bath, in which an alloy consisting approximately of 80% copper and 20% tin is deposited upon the outer surface of the copper sections 34, 49, 50, has been shown to be particularly satisfactory. The thickness of the coating with solder amounts preferably to 60 to 100 micrometers. Subsequently, the copper sections 34, 49, 50 are inserted into the bores 51 to 56 in an appropriate quantity. In this case, one can do without additional cylindrical hard solder rods, since there is already sufficient solder on the surface of the copper sections 34, 49, 50. When the solder is heated to its melting temperature, the copper sections 34, 49 or 50 interconnect to form the surface enlarging insert 27, 39 as well as interconnecting with wall 33 of the bore 51 to 56. In this manner of proceeding, it is advantageously made sure that the solder is present between the wall 33 and the entire surface of the surface enlarging insert 27, 39 which rests at the wall 33 and that no flaws occur in the soldered connection. Thus, good heat transmission between the wall 33 and the surface enlarging insert 27, 39 is assured.

The surface enlarging insert, according to the present invention, in the channels for the heat carrier means can also find use in a conventional discontinuous single or multiplaten press.

Figure 10:
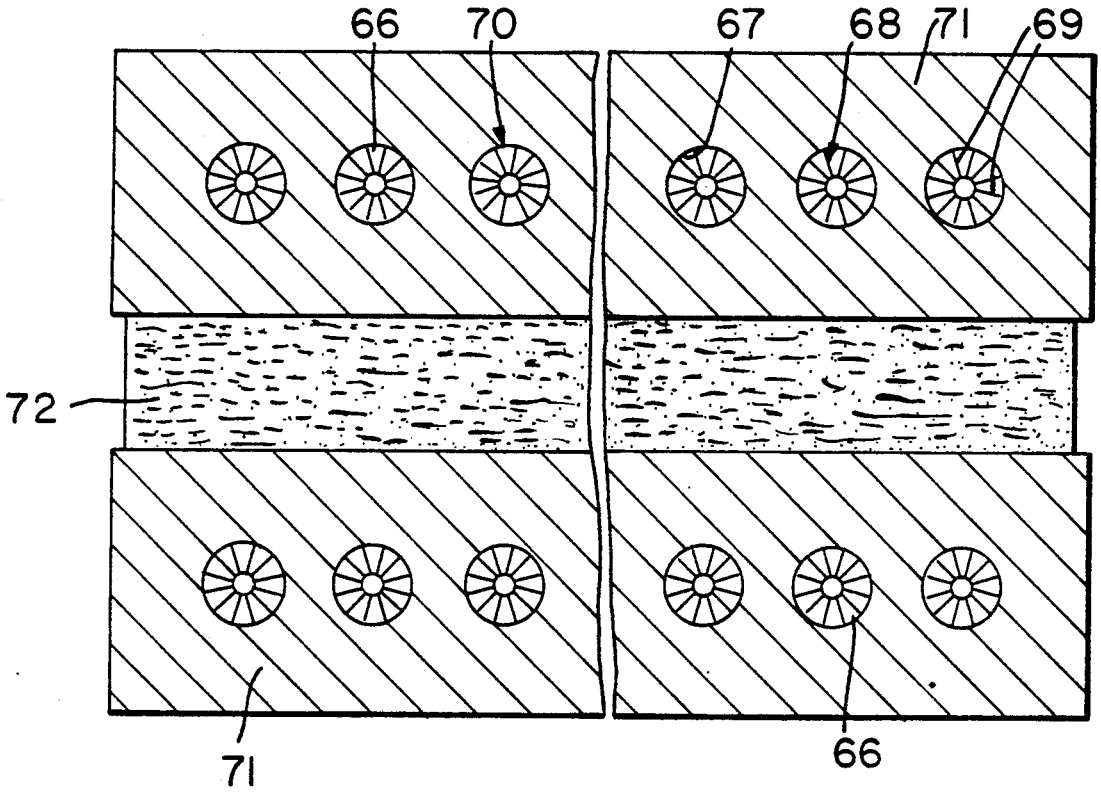
FIG. 10 is a sectional view through the pressure plate of a platen press.

The pressure plates 71 of a single platen press are shown in FIG. 10 between which the commodity 72 to be pressed is extruded, pressed or laminated with the application of heat. Channel 66 formed by longitudinal bores in the pressure plate 71 are configured in the pressure plates 71 for heating the plates. Surface enlarging inserts 68 are again inserted in the channels 66 which, with one surface 70, rests at the wall 67 of each channel 66. Elements 69 emanate from the surface 70 of the surface enlarging inserts 68 which reach into the flow of the heat carrier means. The surface enlarging insert 68 is designed to correspond to the surface enlarging inserts 27 or 39 and is soldered into the channels 66 of the pressure plate 71 in accordance with the process described above. With this, one achieves improved heat transmission between the heat carrier means and the pressure plate also in discontinuous single and multiplaten presses.

The structure of the surface enlarging insert 27, 39, as well as its fabrication, is explained with the help of an example of the pressure plate 11, 12 in the double band press or the pressure plates 71 of a single platen press. If required additional parts of the double band press which are heated or cooled by the heat carrier means flowing in channels 24 of these parts, can be equipped with such surface enlarging inserts 27, 39. This could, for instance, be channels 22 in the mantle 23 of the reversing drums 1 and 4 as well as portions of the press stand. In the design of the surface enlarging insert which is described in the two embodiments, the thought of the invention is important, wherein this insert consists of a material with good heat conduction properties, has several elements emanating from one surface and projects into the flow of the heat carrier means and that this surface is fastened to the wall of the channel of the heat carrier means with a good heat conducting contact.

While specific embodiments of the invention have been shown and described in detail to illustrate the application of the inventive principles, it will be understood that the invention may be embodied otherwise without departing from such principles.

What is claimed is:

1. A double band press for continuous fabrication of material webs, comprising:

two pressing members defining a reaction zone therebetween for pressing a material web therebetween, each of said pressing members including a pressure plate;

heat transfer means for heating or cooling the reaction zone including a plurality of spaced apart bores defining a plurality of channels of circular cross-section for receiving heat carrier means, said bores of said heat transfer means extending through each pressure plate, each pressure plate having a width, one longitudinal side and an opposite longitudinal side, said bores extending transversely across the width of each plate and a plurality of oblong recesses interconnecting adjacent bores at said one longitudinal side of said plates and alternately at said opposite longitudinal side of said plates to form a meandering array of connected channels across each plate;

a plurality of covers engaged with said one longitudinal side and said opposite longitudinal side of each pressure plate, each of said covers covering at least one of said oblong recesses and confining said head carrier means in said channels; and a surface increasing insert disposed in said bores, said surface increasing insert having a continuous surface area with a circular cross-section whose radius is approximately equal to the radius of the bores, said insert having said continuous surface area in heat conducting contact with a wall of said bores, said insert including ak plurality of hollow elements extending from said continuous surface area of said insert into the space of said bores so that the heat carrier means flows past said hollow elements, said plurality of hollow elements dividing the channels into several separate channel segments, each of said inserts extending through the entire length of its respective bore, each bore wall being entirely covered by partial surfaces of the hollow elements, and the hollow segments being arranged in pairs with area contact at a portion of the continuous surface which forms a boundary of the channel segments.

2. A press having at least one platen for discontinuous fabrication of material webs, comprising:

pressure pads arranged so as to press a material web therebetween, each pad having a width, one longitudinal side and an opposite side;

heat transfer means for heating or cooling said pressure pads including bores defining a plurality of channels of circular cross-section for receiving heat carrier means so that heat is exchanged by convection between the heat carrier means and channel walls, said bores extending transversely across the width of each pad and a plurality of oblong recesses interconnecting adjacent bores at one longitudinal side of said pads and alternately at said opposite longitudinal side of said pads to form a meandering array of connected channels across each pad;

a plurality of covers engaged with said one longitudinal side and said opposite longitudinal side of each pressure pad, each of said covers covering at least one of said oblong recesses and confining said heat carrier means in said channels; and a surface area increasing insert of heat conductive material disposed in said bores and extending along the entire bore between two recesses, said insert having a continuous surface with a cross-section whose radius is approximately equal to the radius of the bores, said continuous surface being in heat conducting contact with a wall of said bores, said insert including a plurality of hollow elements extending from said continuous surface into the space of said bores so that the heat carrier means flows past said hollow elements, said plurality of hollow elements being arranged so as to divide the channels into several separate channel segments, the bore walls being entirely covered by partial surfaces of the hollow elements, and the hollow segments being arranged in pairs with area contact at a portion of the continuous surface which forms a boundary of the channel segments.

3. A press according to claim 2, wherein said insert is made of metal.

4. A press according to claim 1, wherein said insert is made of metal.

5. A press according to claim 4, wherein said metal is copper.

6. A press according to claim 4, wherein said insert is connected to the wall of said channel by a solder connection.

7. A press according to claim 6, wherein said solder connection is made of hard solder.

8. A press according to claim 7, wherein said heat carrying means has an operating temperature, the melting point of said hard solder being higher than said operating temperature.

9. A press according to claim 8, wherein the melting point of said hard solder is below the melting point of the metal making up said insert.

10. A press according to claim 9, wherein the melting point of said hard solder is about 600° to 1,000° C.

11. A press according to claim 10, wherein said hard solder comprises a silver alloy.

12. A press according to claim 10, wherein said hard solder comprises a copper and tin alloy.

13. A press according to claim 1, including a gap between said wall of said bore and at least part of the continuous surface of said insert, said gap being completely filled with solder.

14. A press according to claim 1, wherein said insert comprises an outer hollow cylinder carrying said continuous surface, area an inner hollow cylinder concentrically disposed in said outer hollow cylinder, said elements each comprising a radially extending web connected between said inner and outer cylinders, said inner hollow cylinder defining an inner circular channel segments, said channel segments being prismatic, and being defined between adjacent webs around said insert and between said inner and outer cylinders.

15. A press according to claim 14, wherein each web comprises a pair of adjacent radial walls, each prismatic channel segment comprising arcuate portions of said inner and outer hollow cylinders which are connected between a pair of said radial walls which are spaced apart from each other.

16. A press according to claim 15, including a gap between two radial walls forming one of said webs, said gap being completely filled with solder.

17. A press according to claim 1, wherein said channel segments, are circumferentially distributed alternating channel segments having a prismatic cross section and remaining channel segments having a triangular cross section, said alternating prismatic and triangular cross-sectioned segments touching each other, said prismatic cross-sectioned channel segments having outer sides and said triangular cross-sectioned channel segments having outer sides with radii that equal the radius of said insert, said prismatic cross-sectioned channel segments and said triangular cross-sectioned channel segments each having side walls which touch each other.

18. A press according to claim 17, including gaps between adjacent side prismatic and triangular walls of said channel segments, said gaps being completely filled with solder.

19. A press according to claim 1, wherein each cover is soldered to its respective pressure plate.

20. A press according to claim 1, wherein each cover is welded to its respective pressure plate.

* * * * *